United States Patent [19]

Kobzar

[11] Patent Number: 4,498,661

[45] Date of Patent: Feb. 12, 1985

[54] TEEMING LADLE

[76] Inventor: Vladimir E. Kobzar, ulitsa Kosiora, 32, kv. 71, Dnepropetrovsk, U.S.S.R.

[21] Appl. No.: 459,640

[22] PCT Filed: Apr. 23, 1982

[86] PCT No.: PCT/SU82/00015

§ 371 Date: Dec. 23, 1982

§ 102(e) Date: Dec. 23, 1982

[87] PCT Pub. No.: WO82/03582

PCT Pub. Date: Oct. 28, 1982

[30] Foreign Application Priority Data

Apr. 23, 1981 [SU] U.S.S.R. ..... 3279495

[51] Int. Cl.[3] ..... B22D 39/00

[52] U.S. Cl. ..... 266/239; 266/236; 222/595; 222/606; 222/607; 164/337

[58] Field of Search ..... 266/275, 236, 239, 217; 164/337, 437, 439; 222/590, 594, 595, 606, 607

[56] References Cited

U.S. PATENT DOCUMENTS

| | | | |
|---|---|---|---|
| 3,648,761 | 3/1972 | Speith et al. | 164/437 |
| 4,222,506 | 9/1980 | Sakashita et al. | 164/155 |
| 4,270,595 | 6/1981 | Coward | 266/217 |

FOREIGN PATENT DOCUMENTS

| | | | |
|---|---|---|---|
| 874886 | 7/1971 | Canada | 222/607 |

*Primary Examiner*—L. Dewayne Rutledge
*Assistant Examiner*—Robert L. McDowell
*Attorney, Agent, or Firm*—Lilling & Greenspan

[57] ABSTRACT

A teeming ladle with at least one tapping hole (3) formed in the bottom of its body (1). According to the invention, a sleeve (4) is arranged around each tapping hole (3) substantially coaxially therewith. The sleeve (4) has one of its ends tightly connected with the ladle bottom and the other end immersed in the melt during casting. The diameter of the sleeve (4) is so many times larger than that of the tapping hole that after being immersed in the melt, a space is left in the sleeve interior filled with a gas medium under a pressure ranging from 0.02 to 1.0 time the pressure under which the melt is discharged from the ladle.

24 Claims, 5 Drawing Figures

TEEMING LADLE

BACKGROUND OF THE INVENTION

1. Field of the Invention

The present invention relates to metallurgy, and more particularly, to means for teeming molten metal into various kinds of moulds.

The invention is applicable to machines for continuous casting of metal into molds. It may also find extensive use in non-ferrous metallurgy.

2. Description of the Prior Art

In practice, wide use is made of metal teeming means (or ladle) which comprise a teeming chamber connected with refractory-lined sleeves for discharging molten metal into moulds and provided with a system for regulating the level of metal therein. The system in question includes a level-sensing means installed in the mould and connected to electromagnetic means for regulating the flow rate at which the molten metal is discharged from the teeming chamber.

Such construction of the metal-level control system is disadvantageous in that the level-sensing means are directly exposed to the action of molten metal. This in turn renders the control system unreliable in operation and leads to erroneous measurements in the level of metal. Electromagnetic flow gauges are complicated in construction and unreliable in operation under high-temperature conditions, and require substantial power inputs and operational costs.

From the above it follows that the prior-art metal teeming means are complicated in construction and the level control devices incorporated therein are insufficiently reliable in operation.

The error in gauging the level of metal may be as high as 20 percent and more, which brings about overfilling of some moulds and underfilling of others and, in the final count, results in a high degree of defective products and frequent faults in the operation of equipment.

There is also known means for teeming steel into, and regulating its level in the mould of a continuous casting machine. The means in question comprises a stoppered ladle having an actuator associated with a Laser-operated means for gauging the level of metal in the mould. Needless to say that such a construction is rather complicated and expensive due to the use of the Laser technique and optical instrumentation, which require that strictly stable operating conditions be provided in a steelmaking shop. This is an extremely difficult task to perform. Thus it should be mentioned that because of insufficiently reliable operation of the metal gauging means, the rate of errors in gauging the level of metal in the mould increases to bring about faulty operation of the metal-level control means. A higher amount of errors in adjusting the level of metal in the mould is caused by a time delay in cooperation between the metal-level gauging system and the actuator of the ladle stoppered mechanism. This also may result in the overfilling of the mould and, consequently, in damage to the equipment.

SUMMARY OF THE INVENTION

What is desired is a means for teeming molten metal into moulds of such a construction that will be simple and effective enough to ensure reliable and self-regulating adjustment of the metal level in the mould.

Thus the invention provides a teeming ladle which comprises a body having at least one tapping hole formed therein, according to the invention, a sleeve is arranged around each tapping hole substantially coaxially therewith and having one of its ends tightly connected with the ladle bottom, the other end thereof being immersed in the melt during casting; the sleeve having its diameter larger so many times than that of the tapping hole that after immersing the sleeve in the melt, a space is left in the sleeve interior filled with a gaseous medium under a pressure ranging from 0.02 to 1.0 times the pressure under which the melt is discharged from the ladle.

Such ladle construction permits an overpressure of gas to be created inside the sleeve during its immersion in the melt. This pressure produced under the head of metal disposed outside the sleeve acts as the gas medium present inside the latter. The head of metal and, consequently, the pressure of gas under the tapping hole is increased with the depth of immersion of the sleeve in the melt and with the level of metal in the mould; the amount of pressure under which the metal is discharged from the ladle is concurrently decreased along with the flow rate at which the metal is discharged through the tapping hole into the mould.

A drop in the level of metal in the mould brings about a decrease in the gas pressure inside the sleeve under the tapping hole and an increase in the flow rate of metal poured from the ladle.

Thus, since the level of metal in the mould is self-regulated, there is no need in using complicated and unreliable means for sensing and regulating the level of metal in the mould.

The sleeve is preferably made such that its inner diameter is not less than two diameters of the tapping hole, which makes it possible to create optimal operating conditions for the metal teeming means.

It is preferable that the length of the sleeve in the melt be 2 to 6 diameters thereof, which length is determined in accordance with the amount of pressure under which the melt is discharged from the ladle.

The sleeve in the ladle is preferably made detachable. This will ensure easy and effective operation of the teeming ladle, since the worn-out pipe can be easily replaced by a new one.

Each tapping hole in the ladle is preferably provided with a nozzle which is made integral with the sleeve. Such construction will make unnecessary tight connection of the sleeve with the ladle bottom, as in this case the sealing between the nozzle and the sleeve is ensured due to the absence of a joint between the former and the latter.

In addition, such structural arrangement of the teeming ladle is advantageous in that it permits molten metal to flow out of the ladle and be regulated in the mould, and the metal is protected from secondary oxidation.

The sleeve is preferably lined with a refractory material. This prolongs service life of the sleeve and diminishes its cooling effect on the molten metal.

BRIEF DESCRIPTION OF THE DRAWINGS

The metal will be further described, by way of example only, with reference to the accompanying drawings, wherein.

DESCRIPTION OF THE PREFERRED EMBODIMENTS

Figures 1, 2, 3, 4, 5:
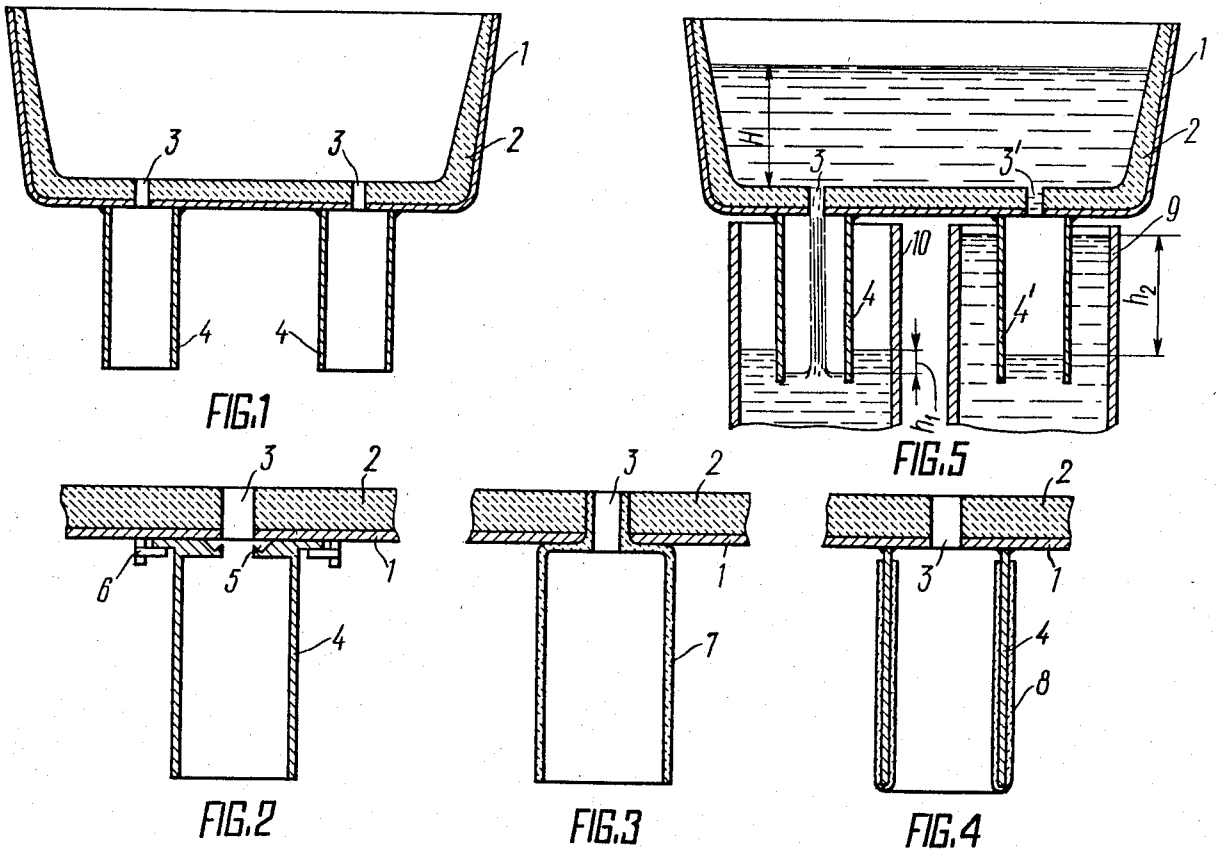
FIG. 1 is a schematic view of a ladle with sleeves tightly connected to the ladle bottom.
FIG. 2 shows another embodiment of the ladle with detachable sleeves.
FIG. 3 shows still another embodiment of the ladle with a teeming nozzle made integral with the sleeve.
FIG. 4 shows an embodiment of the ladle with metal sleeves lined with a refractory material.
FIG. 5 is a view of FIG. 1, showing the ladle in the working position during continuous casting of steel into moulds.

According to the invention, a teeming ladle or, for-/example, a steel-teeming ladle comprises a body 1 lined with a refractory material 2. The ladle has tapping holes 3 formed in its bottom, with a gas-impermeable sleeve 4 positioned around each of the holes 3 and arranged substantially coaxially therewith. Each of the sleeves 4 has its upper end tightly joined with the ladle bottom. The sleeve 4 may be made, for example, of steel.

Such ladle construction permits gas pressure to be produced inside the sleeve 4 during its immersion into the melt, which pressure increases with the depth of immersion of the sleeve 4 in the melt. This promotes self-regulation of the metal level in the mould or in crucibles (not shown) without using complicated and unreliable level-sensing and gauging means or stopper mechanisms generally employed in prior-art teeming ladles.

The diameter of the sleeve 4 is made so many times larger than that of the tapping hole 3 that after immersing the sleeve 4 in the melt, a space is left inside the sleeve 4, which is filled with a gas medium under a pressure amounting to 0.02–1.0 times the pressure under which the melt is flown from the ladle.

The value of the gas overpressure inside the sleeve 4 ranges within the afore-indicated limits, depending on the depth of the sleeve immersion in the melt, that is, on the level of metal in the mould or in a crucible. This pressure will reach its lower limit when the level of metal in the mould is minimal, with approximately the fiftieth part of the sleeve 4 being immersed in the melt. This being the case, the rate of metal flow from the melt is the highest possible, since the overpressure inside the sleeve 4 under the tapping hole 3, preventing the outflow of the melt, is insignificant.

When the level of metal in the mould reaches its critical point, the sleeve 4 is immersed to a maximum depth, and the gas pressure inside the sleeve 4 under the tapping hole 3 is equalized with the pressure under which the melt is flown from the ladle.

In this case, the outflow of metal is discontinued until the level of metal in the mould drops below the critical point.

Thus the level of metal in the mould is self-regulated, which makes unnecessary the use of complicated and unreliable special equipment.

It is preferable that the diameter of the sleeve 4 be at least two times the diameter of the tapping hole 3, whereby it becomes feasible to eliminate the possibility of complete ousting of the gas medium from inside the sleeve by the flow of melt discharged from the tapping hole 3.

The length of the sleeve 4 is determined by the pressure under which the melt is discharged from the ladle, this length generally amounting to 2–6 diameters of the sleeve 4.

With the ladle incorporated in a continuous casting machine, the sleeve 4 is preferably made detachable, such as is shown in FIG. 2. In this case, the worn-out sleeve is readily replaced by a new one, without the need of replacing the ladle as a whole. The sleeve 4 is fixed to the bottom of the ladle by any conventional means, for example, by means of holding clamps 6. Hermetic sealing of the sleeve 4 with the ladle body 1 is preferably carried out by means of filling a narrow annular gap 5 with metal which, on solidification, ensures reliable sealing of the above-mentioned joint. The wornout sleeve 4 can be easily replaced by a new one. At the narrowest place of the gap the metal is broken down all over its periphery and the sleeve 4 is detached from the ladle body 1.

In teeming of steel the tapping hole 3 is preferably provided with a teeming nozzle which is made integral with a sleeve 7, such as is shown in FIG. 3.

By making the nozzle as the piece with the sleeve 7, it becomes possible to cause the molten metal to flow out from the ladle, to control the level of molten metal in the mould, and to protect the metal from secondary oxidation, as it is isolated from the atmosphere.

The nozzle and the sleeve 7 are preferably made from a gas-impermeable refractory material, for example, such as fused quartz. As a result, the service life of the sleeve 4 is prolonged and the cooling effect it has on the molten metal is diminished. The refractory lining may be made in the form of a replaceable refractory jacket 8 attached to the metal part of the sleeve 4, such as is shown in FIG. 4. Such refractory structure is readily replaceable and ensures reliable heat insulation of the sleeve 4.

The ladle of the invention, incorporated, for example, in a machine for continuous casting of steel, operates in the following manner.

First, a certain amount of steel is fed from a pouring ladle (not shown) into the cavity of the intermediate ladle with the body 1 (FIG. 5), wherein the melt is maintained at a level "H". Next, the melt is discharged through the tapping holes 3 into moulds 9 and 10. As the end of the sleeve 4 are immersed in the melt in the mould 10, the gas medium present inside the sleeve 4 be becomes enclosed therein and thus is compressed under the head pressure "$h_1$" of the metal disposed outside the sleeve 4. Both the height of the column "$h_1$" and the overpressure of gas inside the sleeve 4 are not particularly high. As a result of this, the melt is almost unhinderedly flown out of the ladle through the tapping hole 3 into the mould 10. As the level of metal in the mould 9 rises, so does the depth of immersion of the sleeve 4 in the melt. At the same time, the column "$h_2$" increases in height and the gas pressure mounts inside the sleeve 4' thereby preventing the outflow of metal from the ladle into the mould 9. When the metal head pressure "H" is equalized with the metal head pressure "$h_2$", the tapping of metal through the holes 3 into the mould 9 is discontinued. In this way proceeds self-regulation of the level of metal in the moulds 9 and 10.

Prior to immersing the sleeves 4 and 4' in the melt, substances, such as nitrogen-containing ones or sawdust, produced on combustion of neutral or reducing atmosphere, are fed onto the melt surface to prevent the interaction of molten metal with the oxidizing gaseous medium present inside the sleeves 4 and 4'.

As compared to the prior-art intermediate ladles, the ladle of the invention makes it possible:

to dispense without the use of complicated and unreliable stopper devices and control means;

to dispense without the use of complicated and unreliable means for gauging the level of metal in the mould;

to ensure self-regulation of the metal level in the mould;

to improve quality of castings by eliminating the spattering of metal by the stopper appliance during the outflow of the metal jet through the tapping hole;

to combine the control of the metal level in the mould with the protection of the metal jet issuing from the ladle from secondary oxidation.

COMMERCIAL APPLICABILITY

The ladle of the invention is preferably used as an intermediate teeming means at machines intended for continuous casting of steel into moulds.

The invention is appicable for use in nonferrous metallurgy.

I claim:

1. A teeming ladle for use in making molds from a melt comprising a body with a bottom having at least one tapping hole with a gas-impermeable sleeve being arranged around each tapping hole substantially coaxially therewith and having one of its ends tightly connected with the ladle bottom and the other end immersable in the melt during casting, the diameter of said sleeve being substantially larger than that of the tapping hole that after immersing the sleeve in the melt, a space is left in the sleeve interior capable of being filled with a gaseous medium under a pressure ranging from 0.02 to 1.0 times the pressure under which the melt is discharged from the ladle.

2. A teeming ladle as claimed in claim 1, characterized in that the inner diameter of the sleeve is not less than two diameters of the tapping hole.

3. A teeming ladle as claimed in claim 2, characterized in that length of the sleeve is 2 to 6 diameters thereof.

4. A teeming ladle as claimed in claim 1, characterized in that the sleeve is made detachable.

5. A teeming ladle as claimed in claim 2, characterized in that the sleeve is made detachable.

6. A teeming ladle as claimed in claim 3, characterized in that the sleeve is made detachable.

7. A teeming ladle as claimed in claim 1, characterized in that the tapping hole is provided with a teeming nozzle made integral with the sleeve.

8. A teeming ladle as claimed in claim 2, characterized in that the tapping hole is provided with a teeming nozzle made integral with the sleeve.

9. A teeming ladle as claimed in claim 3, characterized in that the tapping hole is provided with a teeming nozzle made integral with the sleeve.

10. A teeming ladle as claimed in claim 4, characterized in that the tapping hole is provided with a teeming nozzle made integral with the sleeve.

11. A teeming ladle as claimed in claim 5, characterized in that the tapping hole is provided with a teeming nozzle made integral with the sleeve.

12. A teeming ladle as claimed in claim 6, characterized in that the tapping hole is provided with a teeming nozzle made integral with the sleeve.

13. A teeming ladle as claimed in claim 1, characterized in that the sleeve is lined with a refractory material.

14. A teeming ladle as claimed in claim 2, characterized in that the sleeve is lined with a refractory material.

15. A teeming ladle as claimed in claim 3, characterized in that the sleeve is lined with a refractory material.

16. A teeming ladle as claimed in claim 4, characterized in that the sleeve is lined with a refractory material.

17. A teeming ladle as claimed in claim 5, characterized in that the sleeve is lined with refractory material.

18. A teeming ladle as claimed in claim 6, characterized in that the sleeve is lined with a refractory material.

19. A teeming ladle as claimed in claim 7, characterized in that the sleeve is lined with a refractory material.

20. A teeming ladle as claimed in claim 8, characterized in that the sleeve is lined with a refractory material.

21. A teeming ladle as claimed in claim 9, characterized in that the sleeve is lined with a refractory material.

22. A teeming ladle as claimed in claim 10, characterized in that the sleeve is lined with a refractory material.

23. A teeming ladle as claimed in claim 11, characterized in that the sleeve is lined with a refractory material.

24. A teeming ladle as claimed in claim 12, characterized in that the sleeve is lined with a refractory material.

* * * * *